United States Patent [19]

Eheim

[11] 4,333,440

[45] Jun. 8, 1982

[54] APPARATUS FOR CONTROLLING RECIRCULATED EXHAUST GAS QUANTITIES IN SELF-IGNITING INTERNAL COMBUSTION ENGINES

[75] Inventor: Franz Eheim, Stuttgart, Fed. Rep. of Germany

[73] Assignee: Robert Bosch GmbH, Stuttgart, Fed. Rep. of Germany

[21] Appl. No.: 127,159

[22] Filed: Mar. 4, 1980

[30] Foreign Application Priority Data

Mar. 10, 1979 [DE] Fed. Rep. of Germany ..... 2909465

[51] Int. Cl.[3] ..... F02M 25/06

[52] U.S. Cl. ..... 123/569; 123/571

[58] Field of Search ..... 123/569, 571

[56] References Cited

U.S. PATENT DOCUMENTS 4,173,205 11/1979 Toelle ..... 123/571

4,192,267 3/1980 Cobb ..... 123/569

*Primary Examiner*—Wendell E. Burns

*Attorney, Agent, or Firm*—Edwin E. Greigg

[57] ABSTRACT

An apparatus is described for controlling recirculated exhaust gas quantities in self-igniting internal combustion engines which have a fuel injection pump. Two parameters, the rpm (preferably via the rpm-dependent suction chamber pressure) and the position of the quantity-adjusting device, are obtained from the fuel injection pump and delivered to a performance-graph memory in which a control value for the recirculated exhaust gas quantity is stored in accordance with these parameters. A recirculated exhaust gas quantity control device is actuated in accordance with the recalled control value.

2 Claims, 1 Drawing Figure

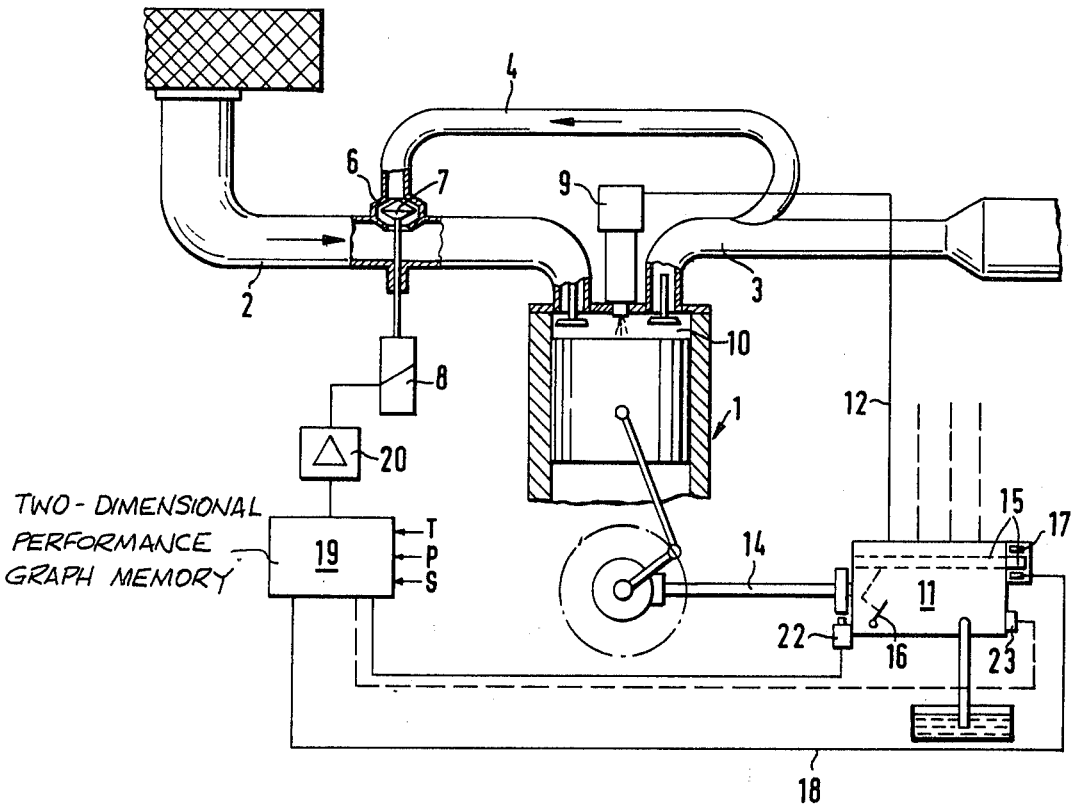
4
6
7
9
2
3
10
8
1
12
20
TWO-DIMENSIONAL
PERFORMANCE
GRAPH MEMORY
19
T
P
S
15
17
14
11
22
16
23
18

APPARATUS FOR CONTROLLING RECIRCULATED EXHAUST GAS QUANTITIES IN SELF-IGNITING INTERNAL COMBUSTION ENGINES

BACKGROUND OF THE INVENTION

The invention relates to improvements in exhaust gas recirculation devices for use diesel fuel injected engines. In a known apparatus of this kind, closed-loop control of the fuel-air ratio is provided, wherein the guide value is the induced air quantity, variable by means of a throttle valve, as measured by an air flow rate meter. The initial value of the air flow rate meter is divided, in a closed-loop control device, by the rpm measured in a fuel injection pump. The value thus attained is compared with a control value, which corresponds to the position of the quantity-adjusting device of the fuel injection pump and represents a value for the fuel injection quantity. The position of the quantity-adjusting device of the fuel injection pump is corrected by means of a final control element on the basis of the amount of deviation from the two control values. The throttle valve here, by its position, also affects the quantity of recirculated exhaust gas which is available, when the induced air quantity is throttled, to make up the remaining filling of the cylinders of the internal combustion engine.

This apparatus is very expensive, and it performs its control function relatively slowly, because if there is a change in the position of the throttle valve the desired values are established only after the elapse of the dead time of the control loop. In particular, there is the danger that because of an excessively large quantity of recirculated exhaust gas, there may briefly be heavy soot formation.

OBJECT AND SUMMARY OF THE INVENTION

The apparatus according to the invention has the advantage over the prior art in that the control values for optimum quantities of recirculated exhaust gas can be stored in a very simple manner and can then very rapidly be called up so as to take into account every change in the fuel injection quantity.

As a result of the features disclosed in the dependent claims, advantageous further embodiments of and improvements to the apparatus are possible. It is especially advantageous that the performance-graph memory is designed as two-dimensional and serves to store control values for the position of the exhaust gas quantity control member in accordance with the rpm and with the fuel injection quantity. The rpm and the fuel injection quantity are uniquely and advantageously characteristic for the operational states of the engine which are of substantial significance in measuring the recirculation of exhaust gas. The required quantity of recirculated exhaust gas can in this manner be set rapidly and with high precision.

The invention will be better understood and further objects and advantages thereof will become more apparent from the ensuing detailed description of a preferred embodiment taken in conjunction with the drawing.

DESCRIPTION OF THE DRAWING

One exemplary embodiment of the invention is shown schematically in the drawing and described in further detail below.

DESCRIPTION OF THE PREFERRED EMBODIMENT

Turning now to the drawings, an internal combustion engine 1 is shown in simplified form in the drawing, with an air intake manifold 2 and an exhaust manifold 3. An exhaust gas recirculation line 4 leads from the exhaust manifold 3 to the air intake manifold 2. The entry of the exhaust gas recirculation line 4 into the air intake manifold 2 is embodied as a valve seat 6 for a closing element 7 of a solenoid or magnetic valve 8. This magnetic valve 8 is embodied as an adjusting magnetic valve, so that the closing element 7 can be moved, depending upon how it is triggered, into a desired position in which a predetermined cross section of the exhaust gas recirculation line 4 is opened.

The internal combustion engine here is a selfigniting internal combustion engine in which the fuel is injected via fuel injection valves 9 into the combustion chamber 10 of the individual cylinders. The fuel injection valves 9 are supplied with fuel from a fuel injection pump 11 via injection lines 12. The injection pump is driven by the engine by way of a shaft 14. The pump has a quantity-adjusting device 15, which is adjustable by means of a lever 16, for example, in accordance with load or the desired torque. The control may accomplished by means of a conventional closed-loop controller or with the aid of an electrical closed-loop controller as well, which takes into account such control values as air quantity, rpm, injected fuel quantity, temperature, and other parameters having an effect on the composition of the mixture arriving to be combusted in the combustion chamber.

In the exemplary embodiment, the injection pump is shown as a series injection pump. Other forms of injection pump, such as distributor injection pumps, which have a fuel quantity-adjusting device, can be used equally well. For the purpose of ascertaining the position of the quantity-adjusting device, a travel path transducer 17 is provided on the fuel injection pump, which in an advantageous manner is an inductive travel path transducer. A connecting line 18 leads from the travel path transducer 17 to a control device 19. This device contains a performance-graph memory, from which a control value can be obtained which corresponds to the output voltage indicated by the travel path transducer. After suitable conversion, this control value is delivered via the amplifier 20 to the magnetic valve 8. The electromagnetic valve 8 is driven in any desirable, known manner. Either a flow of electrical current which corresponds to the control value furnished by the controller 19 is generated by means of a magnetic coil, or the magnetic valve is intermittently actuated with a keying ratio which corresponds to the control value furnished by the control device. However, other output variables which corresponds to the control value can also be generated.

As a result of this embodiment it is possible to assign a predetermined exhaust gas recirculation quantity to each fuel injection quantity by varying the open cross section between the valve seat 6 and the closing element 7. By means of using suitable performance-graph memories, it is possible in simple fashion to store the appropriate control values for various values of the position of the quantity-adjusting device.

In order to make the exhaust gas recirculation control more precise, an rpm transducer 22 is provided on the fuel injection pump the output signal of which is delivered to a two-dimensional performance-graph memory provided in the control device. The other parameter is still the position of the quantity-adjusting device 15. The control value for the quantity of recirculated exhaust gas which is controllable in this performance-graph memory makes it possible to ascertain practically every operational state of the internal combustion engine which is of significance in dosing the exhaust gas recirculation quantities. By taking into account the rpm and the position of the quantity-adjusting device, the quantity of the fuel introduced per unit of time can be ascertained at every point. Furthermore, the threshold ranges for the exhaust gas recirculation, that is, idling and full-load operation, can be taken into account in the same manner. The control of the recirculated exhaust gas quantity thus is accomplished very precisely. When there are abrupt load changes, there is no delay in establishing the correct exhaust gas recirculation value such as is caused in closed-loop controls by the dead times of a control loop.

As the rpm transducer, a inductive transducer can be used which ascertains the rpm of the fuel injection pump; or, in advantageous fashion, a pressure transducer 23 which ascertains the pressure in the suction chamber of the fuel injection pump can also be used. This pressure, because it is used for the purpose of adjusting the injection time, is proportional to rpm, so that the pressure transducer 23 thus furnishes a signal which is likewise proportional to rpm.

In further developing the embodiment, still other parameters such as temperature or air pressure can be taken into consideration for the purpose of affecting the control value for the magnetic valve 8. This may be accomplished via multi-dimensional performance graphs or by means of retroactively influencing the control value furnished by a two-dimensional or three-dimensional performance graph.

With the described apparatus it is possible to attain very precise control of the exhaust gas recirculation quantities very simply and at little expense, with the capacity for following changes in load very rapidly.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for controlling recirculated exhaust gas quantities in self-igniting internal combustion engines supplied with fuel from a fuel injection pump comprising:

a quantity adjusting device attached to the fuel injection pump to control fuel quantity;

an air intake manifold connected to an internal combustion engine, an exhaust gas recirculation line connected from an exhaust manifold of the engine leading and coupled into the air intake manifold;

an rpm transducer connected to a drive shaft of the injection pump;

an exhaust gas quantity control member having an adjusting magnetic valve means and a closing element positioned in the exhaust gas recirculation line;

a travel path transducer connected to detect the position of the quantity adjusting device;

a performance-graph memory means connected to the exhaust gas quantity control member, the rpm transducer and the travel path transducer, and which generates an exhaust gas recirculation quantity control signal to the adjusting magnetic valve means such that the closing element is selectively positioned to open a pre-determined cross-section of the exhaust gas recirculated line according to injection pump drive shaft rpm and quantity adjusting device position.

2. An apparatus as defined in claim 1, also including a pressure transducer connected to detect pressure of the fuel injection pump, and which is connected to generate an rpm signal to the performance-graph memory means.

* * * * *